US008833486B2

(12) United States Patent
Krauter et al.

(10) Patent No.: US 8,833,486 B2
(45) Date of Patent: Sep. 16, 2014

(54) ELASTIC CONNECTION BETWEEN HOUSING PARTS OF MOTOR-DRIVEN POWER TOOLS

(75) Inventors: Jochen Krauter, Hildrizhausen (DE); Joerg Maute, Sindelfingen (DE); Juergen Wiker, Hangzhou/Bing Jiang District Yunnan (CN)

(73) Assignee: Robert Bosch GmbH, Stuttgart (DE)

( * ) Notice: Subject to any disclaimer, the term of this patent is extended or adjusted under 35 U.S.C. 154(b) by 159 days.

(21) Appl. No.: 12/666,199

(22) PCT Filed: May 2, 2008

(86) PCT No.: PCT/EP2008/055409

§ 371 (c)(1),
(2), (4) Date: Dec. 22, 2009

(87) PCT Pub. No.: WO2009/003739

PCT Pub. Date: Jan. 8, 2009

(65) Prior Publication Data

US 2010/0193210 A1 Aug. 5, 2010

(30) Foreign Application Priority Data

Jul. 2, 2007 (DE) ..... 10 2007 030 703

(51) Int. Cl.
*B25D 17/11* (2006.01)
*B25D 17/24* (2006.01)
*B25F 5/00* (2006.01)

(52) U.S. Cl.
CPC ..... *B25F 5/006* (2013.01)
USPC ..... 173/162.1

(58) Field of Classification Search
USPC ..... 173/171, 162.1, 162.2; 403/291; 220/677–692
See application file for complete search history.

(56) References Cited

U.S. PATENT DOCUMENTS

| | | | | | |
|---|---|---|---|---|---|
| 2,462,762 | A | * | 2/1949 | Nardin | 277/609 |
| 2,507,965 | A | * | 5/1950 | Eichner | 16/225 |
| 2,835,360 | A | * | 5/1958 | Bernardoni et al. | 52/204.62 |
| 3,692,335 | A | * | 9/1972 | Vickers et al. | 285/49 |
| 3,880,539 | A | * | 4/1975 | Brown | 404/48 |
| 3,955,441 | A | * | 5/1976 | Johnson | 74/502.4 |
| 4,007,994 | A | * | 2/1977 | Brown | 404/69 |
| 4,067,660 | A | * | 1/1978 | Puccio | 404/69 |
| 4,169,303 | A | * | 10/1979 | Lemelson | 24/452 |
| 4,244,438 | A | * | 1/1981 | Willmann | 181/204 |
| 4,344,555 | A | * | 8/1982 | Wolfberg | 227/130 |
| 4,562,934 | A | * | 1/1986 | Hammond | 220/685 |
| 4,685,686 | A | * | 8/1987 | Weiler | 277/636 |
| 4,800,965 | A | * | 1/1989 | Keller | 173/162.2 |
| 4,837,892 | A | * | 6/1989 | Lo | 16/431 |

(Continued)

FOREIGN PATENT DOCUMENTS

| | | | | |
|---|---|---|---|---|
| DE | 102006060652 | A1 * | 6/2008 | F16J 3/04 |
| EP | 0928669 | A2 | 7/1999 | |

(Continued)

*Primary Examiner* — Robert Long
(74) *Attorney, Agent, or Firm* — Maginot, Moore & Beck

(57) ABSTRACT

An elastic connection is established between housing parts of a power-driven machine tool by an elastic connecting element which is attached in form-locking fashion to at least one of the housing parts to be connected, in such a way that the connecting element has a land penetrating a breach of the housing part, and this land connects covering parts of the connecting element that are located in coincidence with the breach.

9 Claims, 4 Drawing Sheets

(56) References Cited

U.S. PATENT DOCUMENTS

| | | | | | |
|---|---|---|---|---|---|
| 5,048,249 | A * | 9/1991 | Shreiner et al. | 52/396.07 |
| 5,134,812 | A * | 8/1992 | Hoffman et al. | 52/1 |
| 5,333,884 | A * | 8/1994 | Miyaoh et al. | 277/598 |
| 5,348,210 | A * | 9/1994 | Linzell | 228/115 |
| 5,365,713 | A * | 11/1994 | Nicholas et al. | 52/573.1 |
| 5,375,666 | A * | 12/1994 | Pettet et al. | 173/162.1 |
| 5,381,920 | A * | 1/1995 | Lin | 220/843 |
| 5,398,376 | A * | 3/1995 | Pollack | 16/225 |
| 5,435,456 | A * | 7/1995 | Dubach | 220/838 |
| 5,464,323 | A * | 11/1995 | Scofield | 416/134 R |
| 5,469,982 | A * | 11/1995 | Gordecki et al. | 220/4.02 |
| 5,472,214 | A * | 12/1995 | Wainer et al. | 277/609 |
| 5,516,123 | A * | 5/1996 | Eckel | 277/637 |
| 5,522,466 | A * | 6/1996 | Harada et al. | 173/162.2 |
| 5,560,106 | A * | 10/1996 | Armbruster et al. | 30/527 |
| 5,607,635 | A * | 3/1997 | Melbye et al. | 264/167 |
| 5,678,830 | A * | 10/1997 | Chang | 277/631 |
| 5,692,574 | A * | 12/1997 | Terada | 173/162.2 |
| 5,713,111 | A * | 2/1998 | Hattori et al. | 24/452 |
| 5,871,142 | A * | 2/1999 | Josephson | 229/120.09 |
| 5,913,482 | A * | 6/1999 | Akeno | 24/452 |
| 5,972,465 | A * | 10/1999 | Ohno et al. | 428/100 |
| 6,026,910 | A * | 2/2000 | Masterson et al. | 173/162.2 |
| 6,182,527 | B1 * | 2/2001 | Sander | 74/529 |
| 6,220,367 | B1 * | 4/2001 | Masterson et al. | 173/162.2 |
| 6,309,183 | B1 * | 10/2001 | Bucher et al. | 416/210 R |
| 6,641,634 | B2 * | 11/2003 | Reich et al. | 55/385.1 |
| 6,651,400 | B1 * | 11/2003 | Murphy | 52/586.2 |
| 6,685,864 | B2 * | 2/2004 | Bingle et al. | 264/254 |
| 6,827,157 | B2 * | 12/2004 | Fuchs | 173/217 |
| 6,863,499 | B2 * | 3/2005 | Pearce | 416/210 R |
| 6,935,842 | B2 * | 8/2005 | Tai | 416/210 R |
| 6,994,354 | B2 * | 2/2006 | Sakata | 277/598 |
| 7,018,142 | B2 * | 3/2006 | Cooper | 408/124 |
| 7,055,953 | B1 * | 6/2006 | Yves et al. | 351/153 |
| 7,341,394 | B2 * | 3/2008 | Krimm et al. | 403/271 |
| 7,364,166 | B2 * | 4/2008 | Yoakam et al. | 277/616 |
| 7,396,210 | B2 * | 7/2008 | Bucher et al. | 416/210 R |
| 7,431,976 | B2 * | 10/2008 | Hermann et al. | 428/100 |
| 7,451,735 | B2 * | 11/2008 | Riley et al. | 123/195 C |
| 7,470,081 | B2 * | 12/2008 | Miyahara et al. | 403/221 |
| 7,827,950 | B2 * | 11/2010 | Hu et al. | 123/90.38 |
| 7,850,055 | B2 * | 12/2010 | Niblett et al. | 227/156 |
| 7,921,935 | B2 * | 4/2011 | Engelfried et al. | 173/162.2 |
| 8,002,287 | B2 * | 8/2011 | Wagner | 277/551 |
| 8,070,104 | B2 * | 12/2011 | Deazley | 244/137.3 |
| 8,113,735 | B2 * | 2/2012 | Tominaga et al. | 403/274 |
| 8,141,531 | B2 * | 3/2012 | Smith et al. | 123/90.38 |
| 8,186,692 | B2 * | 5/2012 | Durocher et al. | 277/631 |
| 8,241,080 | B2 * | 8/2012 | Ichikawa et al. | 440/76 |
| 8,316,957 | B2 * | 11/2012 | Kuhnle et al. | 173/162.2 |
| 2001/0006719 | A1 * | 7/2001 | Krimm et al. | 428/194 |
| 2002/0096341 | A1 * | 7/2002 | Hagan et al. | 173/170 |
| 2003/0037937 | A1 * | 2/2003 | Frauhammer et al. | 173/48 |
| 2003/0202844 | A1 * | 10/2003 | Bayer | 403/286 |
| 2004/0013486 | A1 * | 1/2004 | Cooper | 408/241 R |
| 2005/0022358 | A1 * | 2/2005 | Hagan et al. | 29/450 |
| 2005/0028997 | A1 | 2/2005 | Hagan et al. | |
| 2005/0061524 | A1 | 3/2005 | Hagan et al. | |
| 2005/0175407 | A1 * | 8/2005 | Demel | 403/408.1 |
| 2005/0189393 | A1 * | 9/2005 | Schnell et al. | 227/130 |
| 2005/0224244 | A1 * | 10/2005 | Kraenzler et al. | 173/162.1 |
| 2005/0263308 | A1 * | 12/2005 | Chang | 173/210 |
| 2006/0113098 | A1 * | 6/2006 | Inagawa et al. | 173/162.2 |
| 2006/0219418 | A1 * | 10/2006 | Arakawa et al. | 173/162.2 |
| 2007/0295521 | A1 * | 12/2007 | Wiker et al. | 173/162.1 |
| 2008/0223594 | A1 * | 9/2008 | Eisenhardt et al. | 173/162.2 |
| 2008/0224421 | A1 * | 9/2008 | Niblett et al. | 277/638 |
| 2008/0302552 | A1 * | 12/2008 | Kondo | 173/217 |
| 2010/0006554 | A1 * | 1/2010 | Inoue et al. | 219/202 |
| 2010/0025062 | A1 * | 2/2010 | Engelfried et al. | 173/162.2 |
| 2010/0078187 | A1 * | 4/2010 | Chen et al. | 173/213 |
| 2010/0186979 | A1 * | 7/2010 | Krauter et al. | 173/162.2 |
| 2011/0011608 | A1 * | 1/2011 | Saur | 173/162.2 |

FOREIGN PATENT DOCUMENTS

| | | | | |
|---|---|---|---|---|
| EP | 1382420 | A2 | 1/2004 | |
| EP | 1533084 | A1 | 5/2005 | |
| WO | 2007048435 | A1 | 5/2007 | |
| WO | WO 2007115845 | A1 * | 10/2007 | B25D 17/04 |

* cited by examiner

ELASTIC CONNECTION BETWEEN HOUSING PARTS OF MOTOR-DRIVEN POWER TOOLS

CROSS-REFERENCE TO RELATED APPLICATION

This application is a 35 USC 371 application of PCT/EP2008/055409 filed on May 2, 2008.

BACKGROUND OF THE INVENTION

1. Field of the Invention

The invention relates to an elastic connection between housing parts of motor-driven power tools, in particular housing parts of electrically powered handheld power tools.

2. Description of the Prior Art

Elastic connections having an elastic connection element to corresponding peripheral regions of housing parts that is disposed spanning the gap are known in the industry and are used for the most various reasons, such as noise abatement, tolerance compensation, and/or construction simplification; depending on the intended application and on the field of use of the particular power tool, different loads on the elastic connection result, and sometimes, loads that can be mastered only conditionally by conventional structural features have to be mastered as well, requiring that a shift be made to special solutions to the problem.

OBJECT AND SUMMARY OF THE INVENTION

It is the object of the invention to embody an elastic connection of the type defined at the outset in such a way that, regardless of its heavy load-bearing capability, it is satisfactory both as a covering element and in damping performance and can be produced economically.

This is attained with an embodiment of the elastic connection according to which the connecting element is attached in form-locking fashion to at least one of the housing parts to be connected, in such a way that the connecting element has a land penetrating a breach of the housing part, and this land connects covering parts of the connecting element that are located in coincidence with the breach. The result for the connecting element is a binding to the respective housing part attached in this way, whose strength is limited in the final analysis only by the strength of the material used for the connecting element and/or the load-bearing capacity of the housing part in the area around the breach.

Given a suitable binding of the connecting element to two or more housing parts, a heavy-duty connection is thus created, which in the vicinity between its peripheral portions, in which it is fixed in form-locking fashion to the peripheral regions of the housing parts, can be designed in its form to suit the given conditions and in its elasticity, damping performance and strength, and connecting elements that have peripheral portions that deviate from one another in their extension direction can even be designed.

Advantageously, the connecting element, for instance with a diaphragm-like design, can have high flexibility in its middle portion located between the peripheral portions, or may be designed with a view to strong damping of vibration. This can be attained among other things as well by providing that for the middle portion, a different material from that for the peripheral portions, or a material that is processed differently from that for those portions, is selected.

Taking into account the loads and strains acting on the connecting element and/or to be transmitted via the connecting element, and given the demands that must be met in terms of design standpoints, a covering part that is in coincidence with a breach can be formed by a respective top part, protruding past the breach and transversely to it, of the land connecting the covering parts, or one common covering strip can be associated as a covering part with a plurality of lands, and it is also within the scope of the invention to design the covering parts associated with a peripheral region differently.

The connection according to the invention can be used for housing parts whose peripheral regions extend essentially toward one another in the same plane or that are offset in steps from one another, or are at angles to one another; the breaches in the corresponding peripheral regions in their course between the covering parts in the connected housing part can be designed differently in shape and/or extent, so that in this way, various loads to be transmitted can be taken into account.

Particularly in conjunction with an arrangement of the peripheral region of a particular housing part that is angled or stepped relative to the extension plane, it is possible within the scope of the invention by way of the connecting element also to achieve a connection that is in the same plane as the housing parts but is optionally offset in fluted fashion, without impairing the other functions of the connecting element and/or the strength of the connection between the housing parts.

In particular, the embodiment of the connection in accordance with the invention is also suitable for being achieved by injection molding, and with the connection of the invention it is possible in particular to attach carrying and/or guiding parts, such as handles or the like, to housing parts, so that given a suitable design of the connecting element, the handle is uncoupled in a vibration-damping way from the housing via the connecting element. Particularly for this last purpose, an annular design of the connecting element, which in the connection between housing parts preferably has a striplike rectilinear course, proves to be practical.

BRIEF DESCRIPTION OF THE DRAWINGS

The invention will be described in detail below in conjunction with the drawings, in which.

DESCRIPTION OF THE PREFERRED EMBODIMENTS

Figure 1:
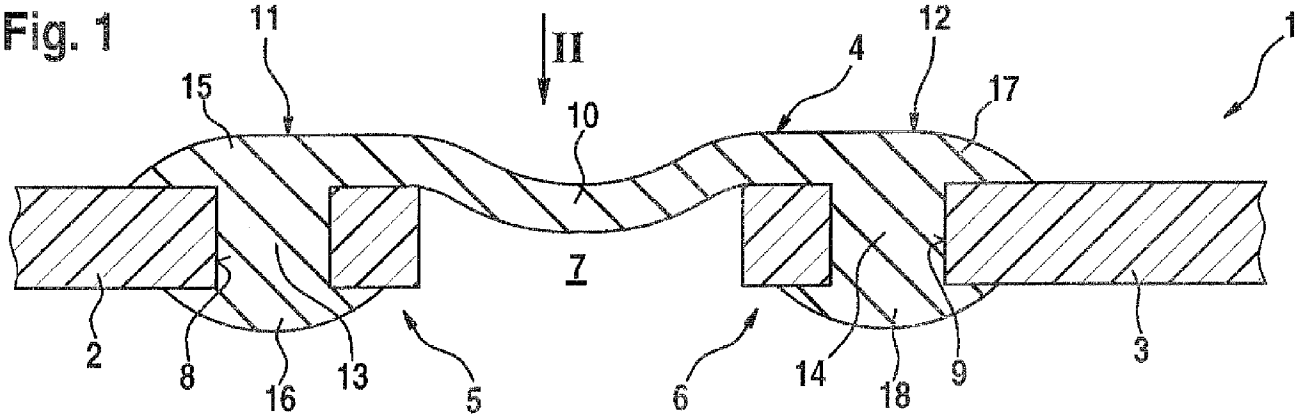
FIG. 1 shows a simplified, schematic cross section, in which two housing parts of a power tool are connected to one another via an elastic connection element, in accordance with the section line I-I in FIG. 2.

Of the housing 1 of the power tool, shown here in the form of an electrically powered handheld power tool, FIG. 1 shows a fragment in which two housing parts 2 and 3 are connected to one another via a connecting element 4. The housing parts 2, 3 are shown only with regard to their adjacent peripheral regions 5, 6 extending approximately in the same direction, which are spaced apart from one another via a gap 7 and which near the periphery toward the gap 7 are provided with breaches 8, 9. The breaches 8, 9 are embodied as peripherally closed openings that penetrate the housing parts 2, 3 transversely to their extension plane. The connecting element 4 is connected to these housing parts 2 and 3 in form-locking fashion fitting over the gap 7 and with respect to the exemplary embodiment shown, it is anchored in the same way relative to housing parts 2 and 3.

Figure 2:
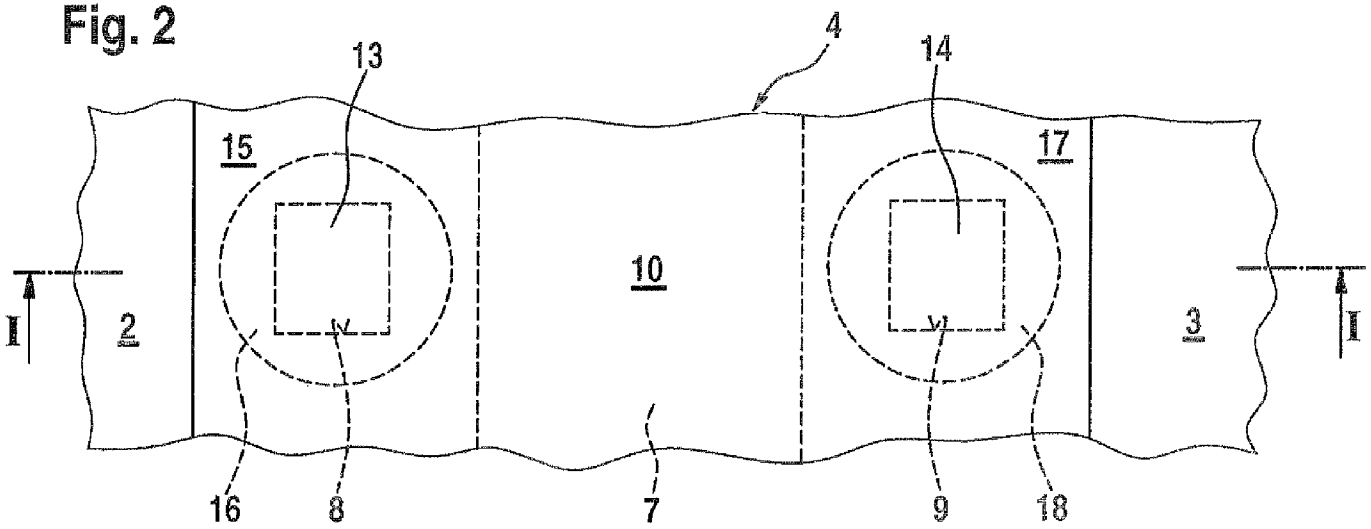
FIG. 2 shows a plan view on the illustration of FIG. 1 in the direction of the arrow II.

The connecting element 4 has a middle portion 10, fitting over the gap 7, which is adjoined by the peripheral portions 11, 12 anchored relative to the peripheral regions 5 and 6; the peripheral portions each include a land 13, 14 penetrating the breach 8, 9 and, coinciding with the breach 8, 9, covering parts 15, 16 and 17, 18, respectively. The covering parts 15, 16 and 17, 18 connected via the respective lands 13 and 14 are each located opposite one another relative to the respective housing part 2 and 3, and the covering parts 15 and 17 are lateral extensions of the middle portion 10, so that in plan view, as seen in FIG. 2, the connecting element 4 is seen as strips that cover both the gap 7 and the peripheral regions 5, 6. The covering parts 16, 18 opposite it relative to the housing parts 2, 3 are embodied as mushroom-shaped top parts that are radially widened compared to the respective land 13, 14, so that each striplike, continuous covering part 15 and 17, respectively, are embodied as individual coverings for the top parts, formed by the covering parts 16 and 18, respectively, that are opposite the respective breaches 8 and 9.

Figure 3:
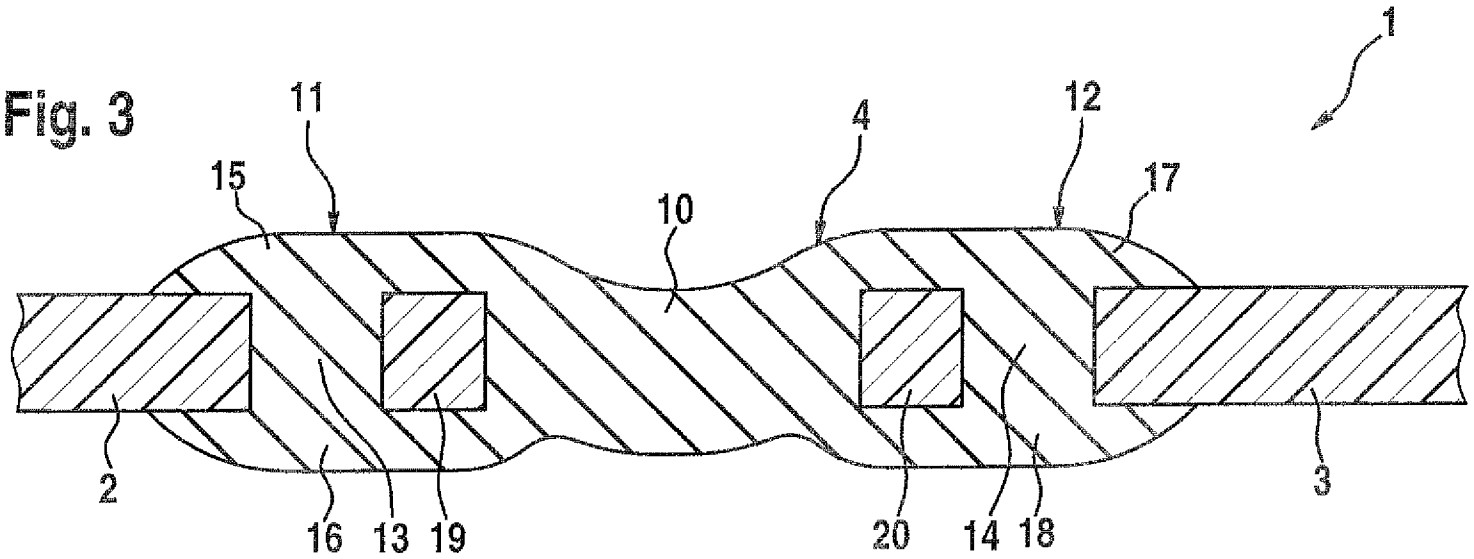
FIG. 3 is further embodiments of an elastic connection according to the invention between housing parts, in a view corresponding to FIG. 1.

The exemplary embodiment of FIG. 3 has a design essentially corresponding to that of FIG. 1, so that with reference to FIG. 1 the reference numerals there are used here as well.

In a departure from FIG. 1, however, the covering parts 16 and 18, with the middle portion 10 and the covering parts 15 and 17 adjoining it, are connected not via the respective land 13 and 14 but instead, like the covering parts 15 and 17, are lateral extensions of the middle portion 10. The respective covering parts 15 and 16 on the one hand and 17 and 18 on the other are thus each connected directly to the middle portion 10, which is connected as an elastic connection member, optionally with a diaphragm-like design, in one piece to the covering parts 15 through 18, so that by means of the connecting element 4 in the vicinity of the breaches 8, 9, the result is that the respective wall part 19, 20 of the respective housing part 2 and 3 that comes to rest adjacent to the gap 7 is embraced in clamped fashion. Such an embodiment is practical, particularly given a striplike embodiment of the peripheral portions 11, 12 that form the covering parts 15 through 18, and results in especially stable anchoring of the connecting element 4 with corresponding bracing of the housing parts 2, 3 relative to one another, and this bracing can be easily produced especially by injection molding as a plastic injection-molded connection and is especially suitable for elastic connections as in FIGS. 5 through 7 as well.

Figure 4:
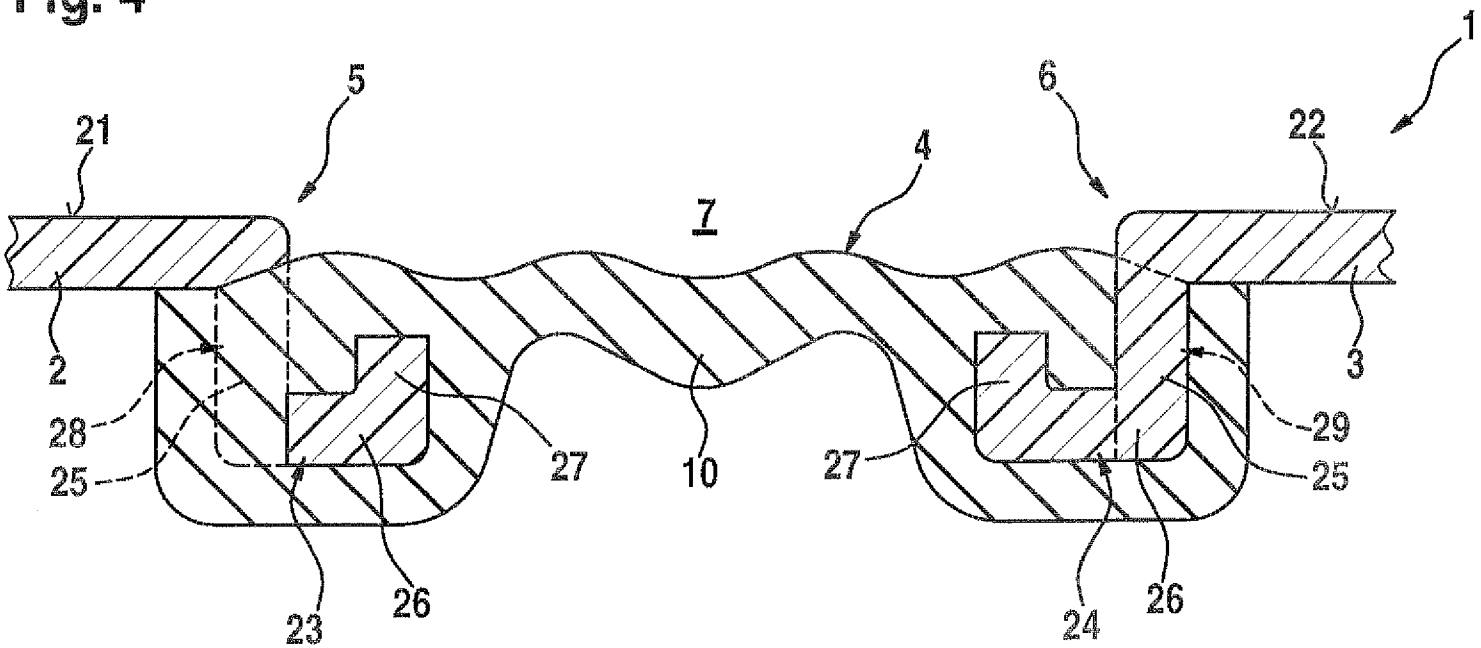
FIG. 4 is further embodiments of an elastic connection according to the invention between housing parts, in a view corresponding to FIG. 1.

The same is correspondingly true for the embodiment of FIG. 4, in which the housing parts 2, 3 in their peripheral regions 5, 6 are likewise surrounded by the connecting element 4, this case with an embodiment of the connecting element 4 in which this element is countersunk in the gap region 7 relative to the housing parts 2, 3, so that a protruding part of the connecting element 4 past the plane defined by the respective housing parts 2, 3 with their top sides 21, 22, is avoided.

While in the embodiments of FIGS. 1 through 3 the housing parts 2, 3 extend toward one another in their peripheral regions 5, 6, and the peripheral regions 5, 6 extend essentially in the same plane with the housing parts 2, 3, in the embodiment of FIG. 4, an angled embodiment of the peripheral regions 5, 6 is provided for. To that end, the housing parts 2, 3 in the peripheral regions 5, 6 are angled transversely to the top sides 21, 22, so that the gap 7 between the housing parts 2, 3 is in the form of a trench, which is bounded laterally by the angled legs 23, 24; in the exemplary embodiment, for improving the form-locking anchoring of the connecting element 4, the legs 23, 24 are embodied as U-shaped angle sections, whose arm 25 angled relative to the top sides 21, 22 changes over into a transverse arm 26, which runs into an arm 27 that is shortened compared to the arm 25 and extends in the same direction as the arm 25. The legs 23, 24 thus form an essentially hooklike profile, which, as shown in the left in FIG. 4, is breached in some portions in the region of the arm 25 extending over to the transverse arm 26, so that once again, the result is breaches 28, 29. In their vicinity of the angled legs 23, 24, the connecting element 4 is embodied as surrounding the legs 23, 24 and penetrating the breaches 28, 29 in lands, which leads to an embodiment that is especially favorable from the standpoint of injection molding and furthermore assures satisfactory form-locking anchoring of the connecting element 4 relative to the housing parts 2, 3, and as in the embodiment of FIG. 3, stable bracing in all load directions is assured, yet without the connecting element 4 fitting over the top sides 21, 22 of the housing parts 2, 3.

Figure 5:
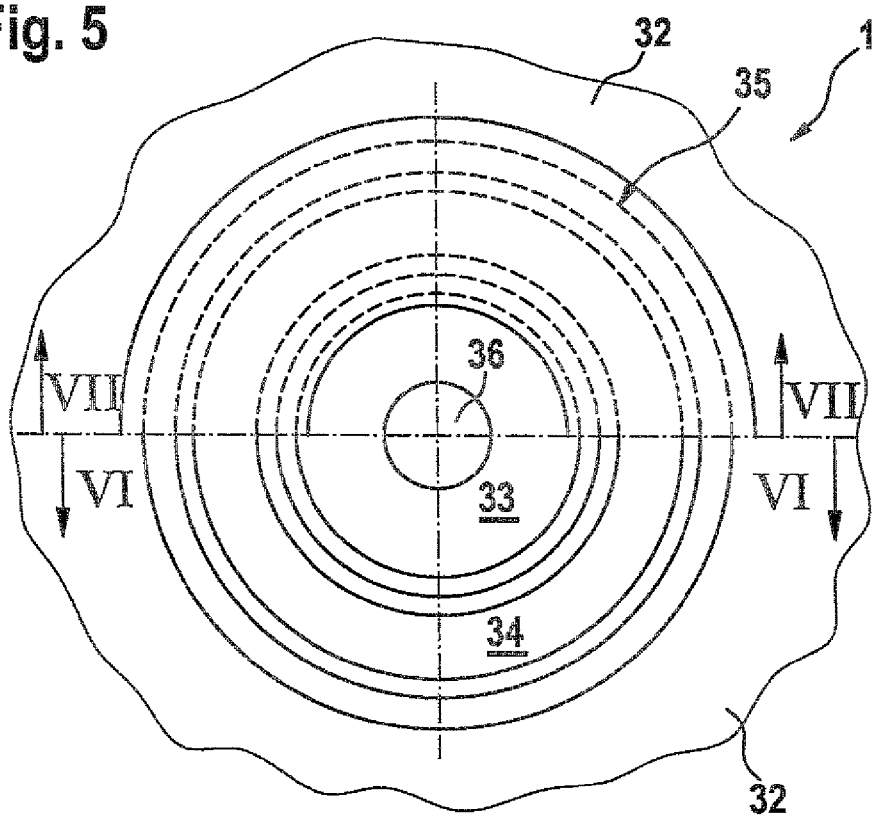
FIG. 5 shows in a plan view, the connection of two housing parts via an annular elastic connection element, in which one of the housing parts is connected to a handle or handhold.
Figure 6:
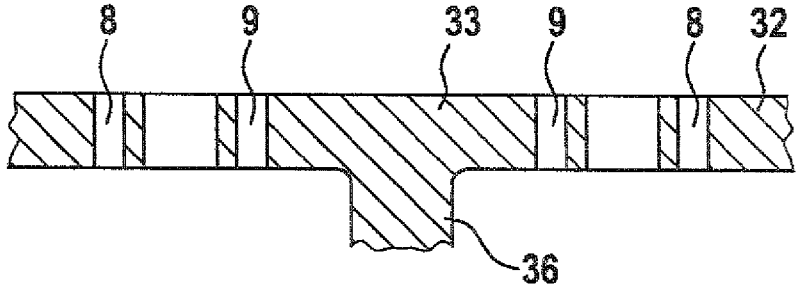
FIG. 6 shows sections corresponding to the view in FIG. 5, taken along the section line VI.
Figure 7:
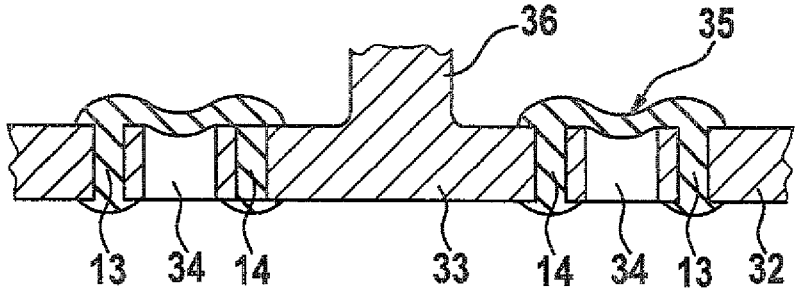
FIG. 7 shows sections corresponding to the view in FIG. 5, taken along the section line VII.

FIGS. 5 through 7 show that connecting elements 4, and elastic connections produced via connecting elements 4, between housing parts 2, 3 may be embodied not only as elongated striplike connecting elements as in FIGS. 1 through 4, but also as ring elements, as can be especially practical for disposing one housing part linking into a further housing part. For instance, in FIG. 5, a housing part 32 is shown, which is located surrounding a housing part 33, and for that purpose, a recess 34 is provided—analogously to the gap 7—in the housing part 2 and has an excess size compared to the housing part 33, so that the housing part 33, with the interposition of an annularly designed connecting element 35, can be affixed elastically resiliently relative to the housing part 32. Preferably, the housing part 32 is provided with a carrying and/or guiding part, such as a handhold, handle, or the like, merely indicated here at 36, so that for the housing identified overall by reference numeral 1, a vibration-damping connection of the housing part 33 that bears the carrying and/or guiding part 36 is the result.

In its embodiment, the connecting element 35 corresponds to the connecting element 4 explained in conjunction with FIG. 3, as indicated in FIG. 6 by reference numerals 8, 9 for the breaches in the housing parts 32, 33 and in FIG. 7 by the reference numerals 13, 14 for the lands, and is distinguished from the connecting element 4 by the annular shape. Correspondingly, the connecting element 35 may also be designed as in FIG. 4. For this, see the descriptions thereof.

FIGS. 5 through 7 show that the housing part 33 that bears the carrying and/or guiding part 36 is buttoned into the housing part 32, received in a recess 34.

Within the scope of the invention, however, a connection corresponding to FIG. 5 of the housing parts 32, 33 is also possible if one housing part, for instance the housing part 32, is embodied with a closed wall and by analogy with FIG. 4 is provided with an annular attachment, which in cross section is designed as protruding toward the wall of the housing part, for instance in a manner corresponding to the leg 23 or 24. The housing part forming the handhold of the carrying and/or guiding part 36 can then be buttoned into this annular attachment to the housing part, by the intermediary of a connecting element as in FIG. 4. As a result, there is no weakening of the housing 1 in the vicinity of the housing part 33 that bears the handhold 36.

Overall, the invention thus affords manifold possibilities of connection between housing parts via an elastic connection element, by way of which an elastic connection between housing parts can be produced in form-locking fashion especially by injection molding.

The foregoing relates to the preferred exemplary embodiments of the invention, it being understood that other variants and embodiments thereof are possible within the spirit and scope of the invention, the latter being defined by the appended claims.

The invention claimed is:

1. A motor-driven power tool, comprising:

an elastic connecting element including (i) a first connector component, (ii) a second connector component, and (iii) a central portion interposed between the first connector component and the second connector component;

a first power tool housing part including a first peripheral region defining a first through-passage; and a second power tool housing part including a second peripheral region defining a second through-passage, said first peripheral region being spaced apart from the second peripheral region so as to define a gap therebetween, wherein the first connector component includes (i) a first covering part positioned on a first side of the first peripheral region, (ii) a second covering part positioned on a second opposite side of the first peripheral region, and (iii) a first link extending through the first through-passage and interconnecting the first covering part and the second covering part, wherein the second connector component includes (i) a third covering part positioned on a first side of the second peripheral region, (ii) a fourth covering part positioned on a second opposite side of the second peripheral region, and (iii) a second link extending through the second through-passage and interconnecting the third covering part and the fourth covering part, wherein the central portion interconnects the first connector component and the second connector component so as to span the gap defined between the first peripheral region and the second peripheral region, and wherein the first and second power tool housing parts are separated from one another and are connected by the elastic connecting element.

2. The power tool of claim 1, wherein:

the first peripheral region includes a first top surface and an opposite first bottom surface, the first through-passage extends from the first top surface to the opposite first bottom surface, the first covering part of the first connector component contacts the first top surface, and the second covering part of the first connector component contacts the opposite first bottom surface.

3. The power tool of claim 2, wherein:

the second peripheral region includes a second top surface and an opposite second bottom surface, the second through-passage extends from the second top surface to the opposite second bottom surface, the third covering part of the second connector component contacts the second top surface, and the fourth covering part of the second connector component contacts the opposite second bottom surface.

4. The power tool of claim 3, wherein the central portion of the elastic connecting element extends from the first covering part of the first connector to the third covering part of the second connector.

5. The power tool of claim 1, wherein the central portion of the elastic connecting element is embodied flexibly in the manner of a diaphragm.

6. The power tool of claim 1, wherein:

the first through-passage extends in a first direction, and the second through-passage extends in the first direction.

7. The power tool of claim 6, wherein:

the central portion of the elastic connecting element extends generally in a second direction, and said second direction is generally perpendicular to the first direction.

8. The power tool of claim 1, wherein the elastic connecting member is formed of an elastomeric part.

9. The power tool of claim 1, wherein the elastic connection assembly is formed by the process of injection molding the elastic connecting element onto at least one of the first housing part and the second housing part.

* * * * *